US009341030B2

(12) United States Patent
Mikalsen et al.

(10) Patent No.: US 9,341,030 B2
(45) Date of Patent: May 17, 2016

(54) LANDING SUB FOR A WIPER

(75) Inventors: Kjell Mikalsen, Narvik (NO); Ketil Botn-Mark, Narvik (NO)

(73) Assignee: 2K TOOLS AS, Narvik (NO)

( * ) Notice: Subject to any disclaimer, the term of this patent is extended or adjusted under 35 U.S.C. 154(b) by 191 days.

(21) Appl. No.: 13/375,874

(22) PCT Filed: Jun. 2, 2010

(86) PCT No.: PCT/NO2010/000204

§ 371 (c)(1),
(2), (4) Date: Jan. 25, 2012

(87) PCT Pub. No.: WO2010/140895

PCT Pub. Date: Dec. 9, 2010

(65) Prior Publication Data

US 2012/0111557 A1 May 10, 2012

(30) Foreign Application Priority Data

Jun. 3, 2009 (NO) ..... 20092155

(51) Int. Cl.

| | |
|---|---|
| ***E21B 17/00*** | (2006.01) |
| ***E21B 23/02*** | (2006.01) |
| ***E21B 12/06*** | (2006.01) |
| ***E21B 37/02*** | (2006.01) |

(52) U.S. Cl.

CPC ..... *E21B 17/006* (2013.01); *E21B 12/06* (2013.01); *E21B 23/02* (2013.01); *E21B 37/02* (2013.01)

(58) Field of Classification Search

CPC ..... E21B 40/00; E21B 12/06; E21B 17/006; E21B 37/00; E21B 37/02; E21B 23/02

USPC ..... 166/382, 162, 242.1, 311, 170, 177.3, 166/153, 173

See application file for complete search history.

(56) References Cited

U.S. PATENT DOCUMENTS

| | | | | |
|---|---|---|---|---|
| 2,257,080 A * | 9/1941 | Turner | ..... | 175/318 |
| 2,540,464 A * | 2/1951 | Stokes | ..... | 175/335 |
| 4,923,011 A | 5/1990 | Skipper | | |
| 5,343,946 A | 9/1994 | Morrill | | |

FOREIGN PATENT DOCUMENTS

| | | |
|---|---|---|
| GB | 2237046 A | 4/1991 |
| WO | WO 2006/006872 A1 | 1/2006 |

* cited by examiner

*Primary Examiner* — Jennifer H Gay
*Assistant Examiner* — George Gray
(74) *Attorney, Agent, or Firm* — Knobbe, Martens, Olson & Bear, LLP

(57) ABSTRACT

Disclosed is a landing sub for a wiper. The wiper is adapted for internal removal of drilling mud from a drill string during its pull-out from a borehole. The landing sub is mountable in the drill string, the landing sub includes a longitudinal bore for through-flow of drilling mud and a landing seat for receiving the lower end of the wiper during pumping of drilling mud through the drill string, and the landing seat is equipped with at least one duct or passage for through-flow of drilling mud past the lower end of the wiper during continued pumping of drilling mud in the drill string.

7 Claims, 3 Drawing Sheets

Section C (Version 1)

Section C (Version 2)

LANDING SUB FOR A WIPER

The present invention relates to a landing sub for a wiper, the wiper being adapted for internal removal of drilling mud from a drill string during pull-out of the drill string from a borehole.

When drilling for oil both onshore and offshore, there is often a need to pull out the drill string, which consists of pipe sections that are screwed together, and the associated bottom drill bit. During pull-out, i.e., the tripping operation, it is most usual that three such connected pipe sections, often referred to as a stand, are taken out in successive order and then set aside or stacked on a separate pipe rack.

During drilling procedures problems sometimes arise because the drilling mud, owing to inadequate or no cleaning at all, remains on the inside of the wall of the pipe sections after pull-out of the drill string during the tripping operation. The mud may thus dry and form hard flakes or clumps on the pulled-out pipe sections. When these pipe sections are to be redeployed, hard clumps or flake particles may be pumped down to the drill bit, and thus block one or more of its nozzles. In the worst case, the result of this is extensive damage to the drill bit, or also that problems arise in connection with, for example, downhole tools and motors.

Another drawback of inadequate removal of drilling mud during the tripping operation is undesired spillage of drilling mud on the deck of the drilling rig or in storage areas in the vicinity of the pipe rack. This causes unnecessary work cleaning the deck and disposing of the mud spillage, and, in the worst case, it could result in injuries due to a slippery and muddied deck.

To remedy the problems mentioned above, many alternative solutions are found in the patent literature, where, for instance, WO-A1 2006/006872 provides an example of wipers for internal removal of drilling mud from the drill string. In this case, the wiper is made having a mass and a volume that allow it to float on top of the drilling mud during the tripping operation. The wiper is bellows-shaped and comprises a weight that is connected to its upper part. Furthermore, the wiper is equipped with one or more channels past or through it so as to allow through-flow of the drilling mud. Reference is also made to this document as such for a closer understanding of the mode of operation of this type of wiper, without this thereby being regarded as limiting in respect of the use of other wiper types in the present invention.

When the wiper is used in connection with tripping operations, situations may however arise in which the pumps must be connected very rapidly, whilst the wiper is still inside the drill string. The result consequently is that the wiper is pumped downwards until it eventually stops in the drill string, for example, 5000 meters down. Furthermore, it is a condition that the pumping of drilling mud should continue unobstructed, even after the wiper has come to a halt in the drill string.

To meet these challenges in connection with such situations involving re-connection of to the pumps, there is proposed, according to the present invention, a landing sub for a wiper, the wiper being adapted for internal removal of drilling mud from a drill string during its pull-out from a borehole, characterised in that the landing sub is mountable in the drill string, comprises a longitudinal bore for through-flow of drilling mud and a landing seat for receiving a lower end of the wiper during pumping of drilling mud through the drill string, and is also equipped with at least one duct or passage for through-flow of drilling mud past the lower end of the wiper during continued pumping of drilling mud in the drill string.

The landing seat may advantageously be formed as an integral part of the longitudinal bore in the landing sub, or alternatively be inserted loose into the same bore.

To allow unobstructed through-flow of the drilling mud, the landing seat can be equipped with a central bore which is in communication with a central bore that extends longitudinally through the wiper. This effect can be strengthened by equipping both the landing seat and the wiper with a respective central bore.

Other advantageous features of the present invention are set forth in the dependent claims and in the description below.

A more detailed explanation of the present invention will be given below with reference to the appended drawings, wherein.

Figure 3:
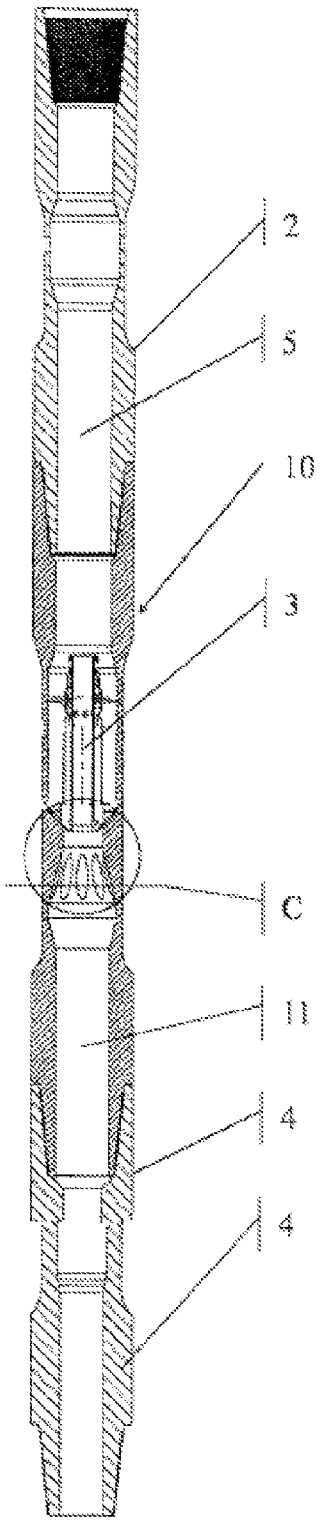
FIG. 3 shows the same as FIG. 1, with an enlarged view of a vertical section FIG. 3.

As shown in the drawings, the landing sub 10 according to the present invention is mountable in a drill string 2, and then preferably in its lower portion. Below the landing sub, the drill string can, if required, be replaced, for example, by a bottom-hole string 4, a heavy drill pipe and the like or other equipment of an appropriate type. The mounting in the drill string can be effected in any way, such as by threaded connections. See FIG. 3. To allow through-flow of drilling mud, the landing sub is configured with a longitudinal bore 11 having a cross-sectional dimension that at least substantially corresponds to the flow area 5 of the drill string 2. The length of the landing sub is about 2 to 3 meters, but of course without this length specification being regarded as a particular limitation.

Figure 1:
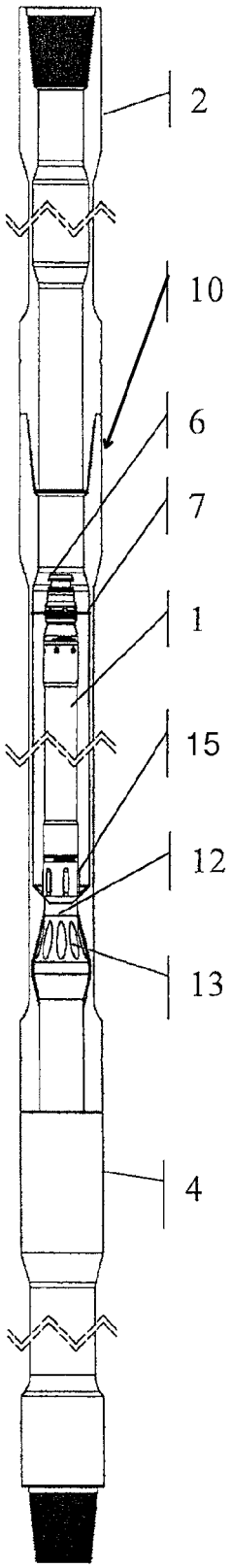
FIG. 1 is a schematic illustration of a preferred landing sub in partial section.

Above, mention has already been made of situations in which the pumping must suddenly be resumed during the tripping operation. In such acute situations, the pumping will quite naturally result in the drilling mud carrying the wiper 1 with it downwards in the drill string 2. To prevent the wiper from passing out through the landing sub 10, or even right out of the drill string, the longitudinal bore 11 is equipped with a landing seat 12 (see FIG. 1) that is intended to catch and retain the wiper inside the landing sub. Furthermore, the landing seat is so positioned in the bore through the landing sub that preferably the whole wiper is located within the actual bore.

To ensure stable positioning, the landing seat has a shape or form which at least partly corresponds to an adjacent portion of the wiper, for example the wiper nose 15. See FIG. 1. Moreover, it will be understood that the landing seat acts as a rest for the wiper during the pull-out of the last connected pipe section during ordinary tripping of the drill string. Similarly, the landing seat can of course be configured as an integral part of the landing sub, or alternatively it can be constituted of a loose seat that is inserted into the bore in any suitable way. As the last-mentioned can be done in a number of ways, it would be going beyond the limits of this description to provide a detailed discussion here. Beyond this, the wiper is provided with a fish neck 6 that is used in connection with any retrieval of the drill string 2 with the aid of a special fishing tool, not shown. The wiper may be equipped with at least one wiper member, for example, of the type shown in WO-A1 2006/006872.

Figure 3A:
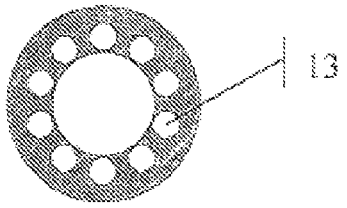
FIG. 3A and FIG. 3B depict two alternative versions of sectional views taken through the line C in panel A.
Figure 3B:
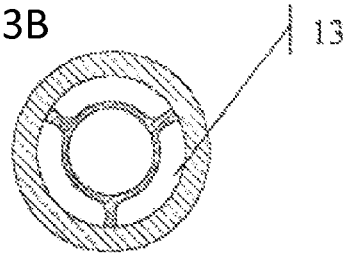
Figure 3B:
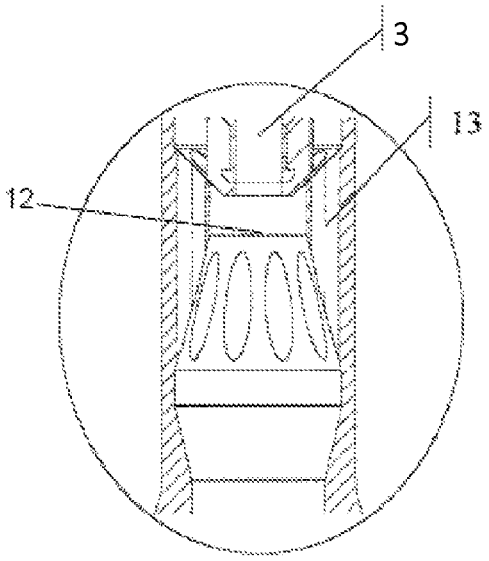

It can also be seen from the drawings that the bore 11 in the area of the wiper 1 above the landing seat 12 normally has an enlarged cross-section, so that through-flow of drilling mud is permitted without being obstructed by the wiper during the pumping operation. Furthermore, the landing seat is provided with at least one duct or passage 13 (see FIG. 3, FIG. 3A and FIG. 3B) which allows the free through-flow via the landing seat to be maintained.

Figure 2:
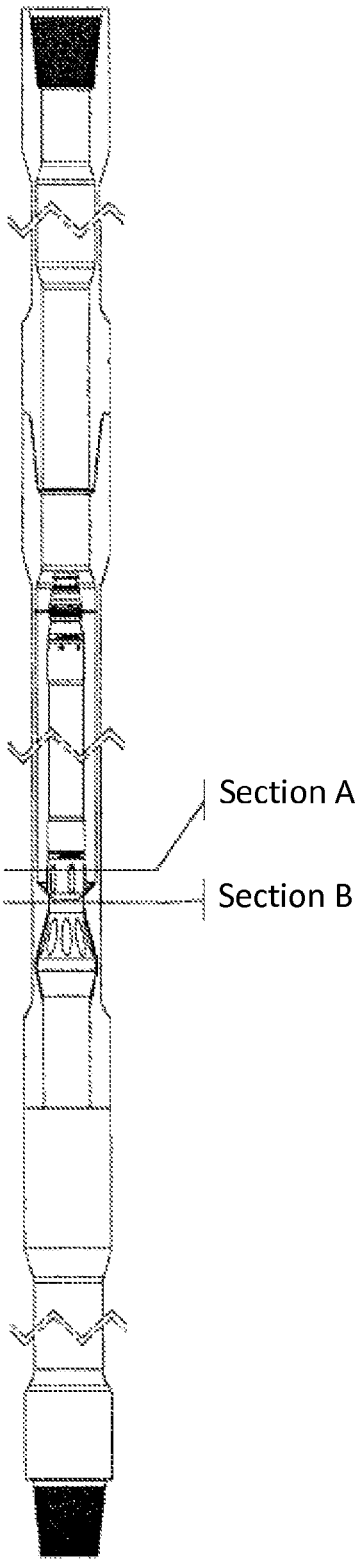
FIG. 2 shows the same as FIG. 1, with two sectional views, FIG. 2A and FIG. 2B, taken through lines A and B.
Figure 2A:
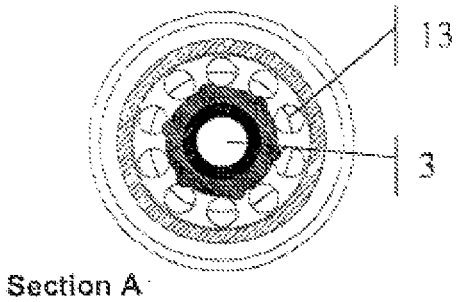
Figure 2B:
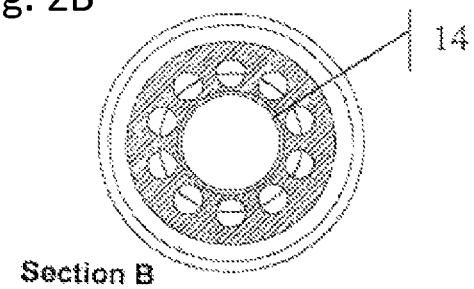

To further facilitate unobstructed through-flow of drilling mud during the pumping, both the landing seat 12 and the wiper 1 are provided with their respective bore 14, 3, as is shown in more detail in the sectional views in FIG. 2A and FIG. 2B. In this connection it is regarded as most appropriate that the diameter of the central bore in the landing seat should be smaller than the external diameter of the nose 15 of the wiper.

The invention claimed is:

1. A landing sub for a wiper, the wiper being adapted for internal removal of drilling mud from a drill string during its pull-out from a borehole, the drill string having a cutting member, wherein the landing sub is configured to be mounted in the drill string, wherein the landing sub comprises a longitudinal bore configured to permit flow-through of drilling mud and a landing seat configured to receive a lower end of the wiper during pumping of drilling mud through the drill string, wherein the landing seat is not adjacent to and not integrated with the cutting member, wherein an upper surface of the landing seat has a shape or form that corresponds to the lower end of the wiper, and wherein the landing seat comprises at least one duct or passage configured to permit flow-through of drilling mud past the lower end of the wiper during continued pumping of drilling mud in the drill string below the landing seat.

2. A landing sub according to claim 1, wherein the landing seat is formed as an integral part of the longitudinal bore in the landing sub.

3. A landing sub according to claim 1, wherein the landing seat is configured to be inserted in the longitudinal bore in the landing sub.

4. A landing sub according to claim 1, wherein the landing seat is located at a sufficient distance from an upper end of the landing sub and is configured to receive essentially the whole wiper in the longitudinal bore.

5. A landing sub according to claim 1, wherein the landing seat is made having a central bore which is in communication with a central bore that extends longitudinally through the wiper.

6. A landing sub according to claim 1, wherein the landing sub is mounted in a drill string using threaded connections.

7. A landing sub according to claim 1, wherein the longitudinal bore in the area of the wiper above the landing seat has an enlarged cross-section, so that through-flow of drilling mud is permitted without being obstructed by the wiper during the pumping operation.

* * * * *